US008240814B2

(12) United States Patent
Saikawa et al.

(10) Patent No.: US 8,240,814 B2
(45) Date of Patent: Aug. 14, 2012

(54) PRINTING HEAD

(75) Inventors: Hideo Saikawa, Machida (JP); Kyosuke Toda, Hachioji (JP); Keiichiro Tsukuda, Yokohama (JP); Takayuki Ono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 12/478,313

(22) Filed: Jun. 4, 2009

(65) Prior Publication Data

US 2009/0309923 A1 Dec. 17, 2009

(30) Foreign Application Priority Data

Jun. 17, 2008 (JP) ..... 2008-157900
May 18, 2009 (JP) ..... 2009-120038

(51) Int. Cl.
*B41J 2/135* (2006.01)

(52) U.S. Cl. ..... 347/44

(58) Field of Classification Search ..... 347/20, 347/44, 45, 50, 86
See application file for complete search history.

(56) References Cited

U.S. PATENT DOCUMENTS

| | | | |
|---|---|---|---|
| 6,631,966 | B2 | 10/2003 | Watanabe et al. |
| 7,063,411 | B2 | 6/2006 | Shyu et al. |
| 7,607,758 | B2 | 10/2009 | Hatasa et al. |
| 2007/0006459 | A1 | 1/2007 | Ono et al. |
| 2009/0002453 | A1 | 1/2009 | Ono |
| 2009/0102893 | A1 | 4/2009 | Tatsumi et al. |
| 2009/0309926 | A1 | 12/2009 | Toda et al. |
| 2009/0309927 | A1 | 12/2009 | Shimazu et al. |

*Primary Examiner* — An Do
(74) *Attorney, Agent, or Firm* — Fitzpatrick, Cella, Harper & Scinto

(57) ABSTRACT

A printing head, which can suppress the occurrence of cracks in a printing element substrate, even if accidentally dropped, includes the printing element substrate, an ink flow passage and a sheet-shaped portion comprising a rectangular major surface. A rear surface side of the major surface of the sheet-shaped portion is provided with a space formed separately from the ink flow passage. A surface adjacent to the major surface is provided with an opening of the space formed therein, and the sheet-shaped portion is provided with a concave portion formed on the rear surface side of two regions between the printing element substrate and two corner portions arranged proximate to the opening.

12 Claims, 21 Drawing Sheets

PRINTING HEAD

BACKGROUND OF THE INVENTION

1. Field of the Invention

The present invention relates to a printing head. In particular, the present invention relates to a printing head, comprising a support member, being formed of a resin material, to which a printing element substrate of the printing head is bonded.

2. Description of the Related Art

A printing technique using an inkjet method has been known in terms of a low running cost and quiet printing method. In order to provide an inkjet printing apparatus at a lower price, it is effective to achieve a lower cost of a printing head for ejecting ink droplets that accounts for a high proportion of the total cost. A printing element substrate that is a chip for ejecting ink is accurately positioned in the surface of the printing head and bonded and secured thereto. In the printing head that has achieved a lower cost, the bonding surface, to which the printing element substrate is bonded and secured, often comprises a resin member. This is because the printing head can be produced at lower cost by use of an injection-molding technique than in case where the bonding surface of the printing element substrate comprises a member, for example, such as a ceramic member, other than the resin member.

Incidentally, in mounting a printing head to an inkjet printing apparatus, in order to ensure excellent printing quality, the dimension from the mounting reference surface to an orifice, through which ink is ejected, of a printing element substrate is required to be controlled and maintained accurately. For this reason, high flatness is needed for the bonding surface to which the printing element substrate is bonded. In order to achieve high flatness, it is preferable to keep the mold shrinkage factor of a molding resin uniform, and the thickness of the bonding surface (adhesion surface), to which the printing element substrate is adhered, comprising a resin member is required to be uniform as much as possible. Moreover, in achieving further cost reduction, for example, the shape of an ink flow passage for supplying ink to the printing element substrate and the shape of a mounting portion of a filter for removing dusts in ink are often formed from a supporting member comprising the same resin member. Accordingly, on the rear surface side of the bonding surface of a printing element substrate, a cavity portion for achieving uniform thickness is often provided (for example, see U.S. Pat. No. 7,063,411).

In a printing head having a cavity portion formed therein, an opening of the cavity portion is formed in a surface adjacent to the surface having the bonding surface and thus the strength of a portion proximate to the opening of the surface having the bonding portion is reduced.

Accordingly, for example, in mounting the printing head to the printing apparatus, if the printing head accidentally falls from an elevated place and the above-described portion having poor strength of the printing head receives an impact, the printing element substrate provided in the printing head may be damaged to cause printing failures.

As an example, with reference to FIG. 20 and FIG. 21, a printing head having a protruding portion H3560 on substantially the same plane as the bonding surface of a printing element substrate is described. FIG. 20 shows a state immediately before a printing head is fallen onto a floor, while FIG. 21 shows a state immediately after the printing head is fallen onto the floor. After the fallen printing head H3000 hits the floor, an impact from the floor is applied to the protruding portion H3560. Then, a bonding surface H3570, to which a printing element substrate H3100 is bonded, of a supporting member H3500 will be subjected to deformation due to the impact at the time of collision. Since the printing element substrate H3100 is bonded to the supporting member H3500 with an adhesive or the like, this deformation causes the printing element substrate H3100 to deform via the adhesive. Such deformation of the printing element substrate is undesirable because the deformation affects the printing quality.

Note that, in FIG. 20 and FIG. 21, a configuration has been described in which the protruding portion H3560 is formed on substantially the same plane as the bonding surface of the printing head. However, even in cases where the protruding portion H3560 is not formed in the printing head, an impact from the floor will transmit from a corner of the supporting member H3500 to the bonding surface H3570, thereby deforming the printing element substrate H3100, as with the above-described case.

Particularly, in cases where a rectangular ink supply port extending through the printing element substrate is provided in the printing element substrate, if the printing element substrate deforms due to an impact applied to the printing head, this deformation may have serious influence on the printing quality. This ink supply port is processed by anisotropic etching and has corner portions. Therefore, the deformation of the printing element substrate H3100 concentrates on a corner portion of the ink supply port. If this deformation becomes excessive, a crack may occur in the printing element substrate. A crack in the printing element substrate may disconnect wirings and the like inside the printing element substrate, causing printing failures.

SUMMARY OF THE INVENTION

The present invention has been made in light of the above-described problems. It is thus an object of the present invention to provide a printing head, wherein the deformation amount of a printing element substrate is small even if the printing head is erroneously fallen.

In order to achieve the above-described object, according to an aspect of the present invention, a printing head comprises: a printing element substrate for ejecting ink and printing; an ink flow passage for supplying ink to the printing element substrate; and a sheet-shaped portion having a rectangular major surface in which the printing element substrate is secured and arranged, wherein a rear surface side of the major surface of the sheet-shaped portion is provided with a space formed separately from the ink flow passage, wherein an opening of the space is formed in a surface adjacent to the major surface, and wherein the sheet-shaped portion has a concave portion formed on the rear surface side of two regions between the printing element substrate and two corner portions arranged on a near side of the opening in the major surface.

According to the above-described configuration, when the printing head is erroneously fallen from an elevated place, the region in which the concave portion is formed on the rear surface side of the sheet-shaped portion becomes likely to deform because the stiffness becomes small as compared with cases where the concave portion is not formed on the rear surface side. Therefore, the deformation amount of the region, in which the printing element substrate is secured, of the sheet-shaped portion can be suppressed, and the amount of deformation pertaining to the printing element substrate can be suppressed.

Further features of the present invention will become apparent from the following description of exemplary embodiments (with reference to the attached drawings).

DESCRIPTION OF THE EMBODIMENTS

Hereinafter, the embodiments of the present invention will be described in detail with reference to the accompanying drawings.

First Embodiment

Figure 1:
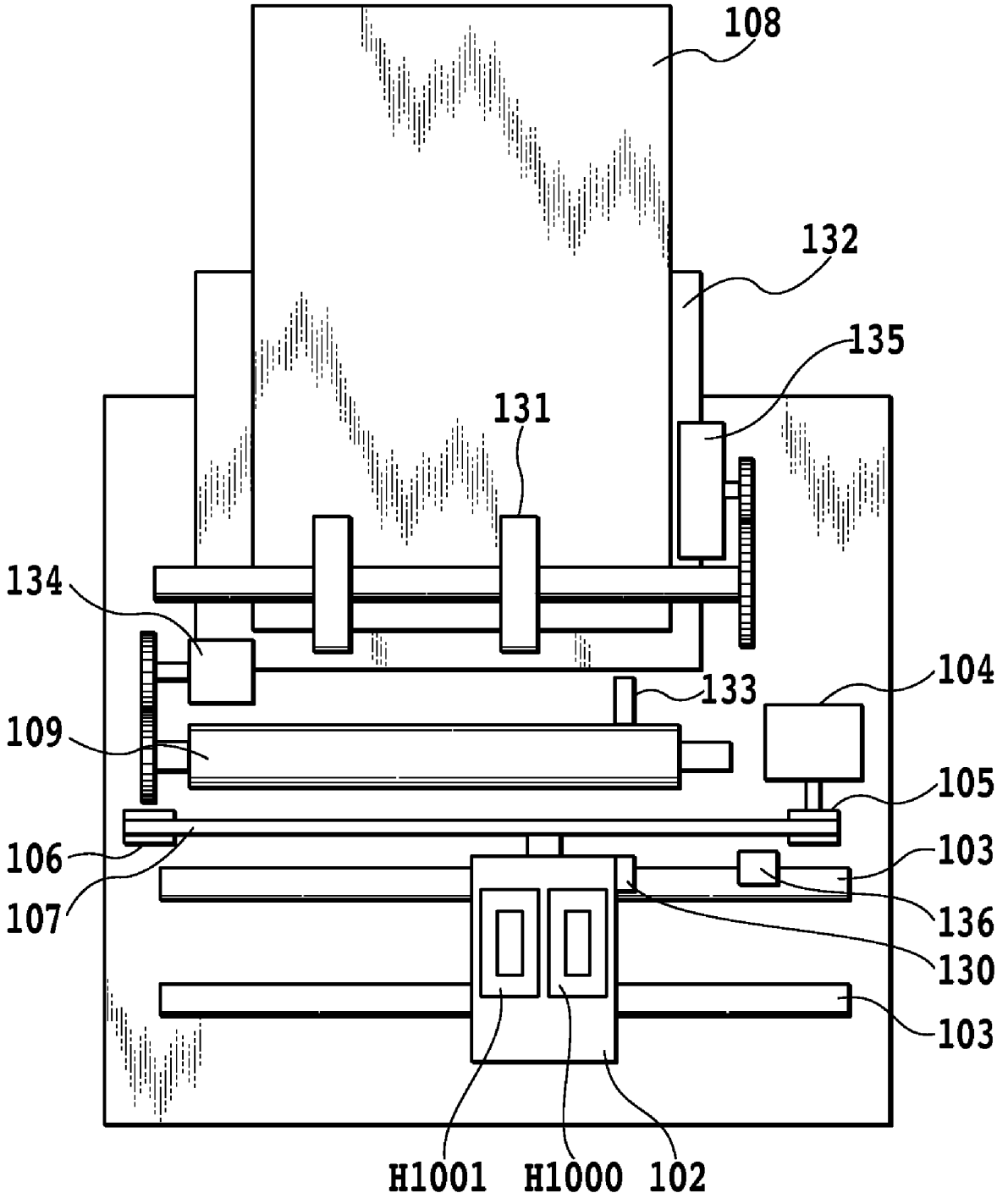
FIG. 1 is a schematic structural view of an inkjet printing apparatus in an embodiment of the present invention.

FIG. 1 is a schematic structural view showing a configuration of an inkjet printing apparatus in an embodiment of the present invention. The inkjet printing apparatus repeats an operation of reciprocating a first printing head H1000 and a second printing head H1001 in a main-scanning direction and an operation of conveying a printing medium 108 in a sub-scanning direction at every predetermined pitch. In synchronization with these movements, ink is selectively ejected from the first printing head H1000 and the second printing head H1001 and applied to the printing medium 108, thereby forming texts, symbols, images, and the like.

The first printing head H1000 and the second printing head H1001 are detachably mounted on a carriage 102. The carriage 102 is slidably supported by a guide shaft 103, and is reciprocated along the guide shaft 103 by a driving means of a non-illustrated motor or the like. The printing medium 108 faces toward ink ejection surfaces of the first printing head H1000 and the second printing head H1001 by a conveying roller 109. Then, the printing medium 108 is fed in the sub-scanning direction perpendicular to the direction of the movement of the carriage 102 so as to keep the distance between the printing medium 108 and the ink ejection surface constant.

The printing head of this embodiment is integrated with an ink tank, and the first printing head H1000 is filled with a black ink and the second printing head H1001 is filled with a plurality of color inks.

Figure 2:
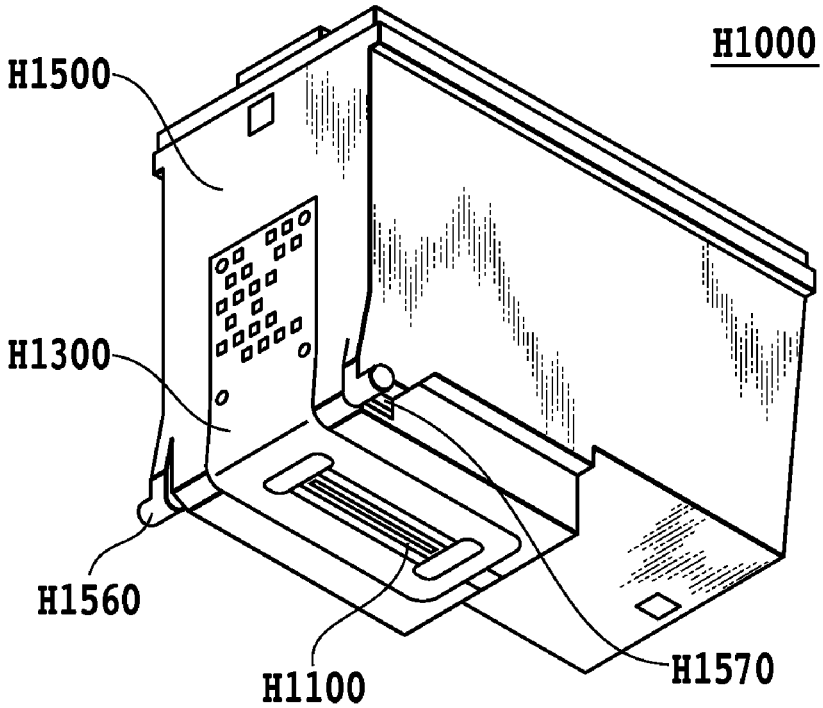
FIG. 2 is a perspective view showing a first printing head of this embodiment.
Figure 2:
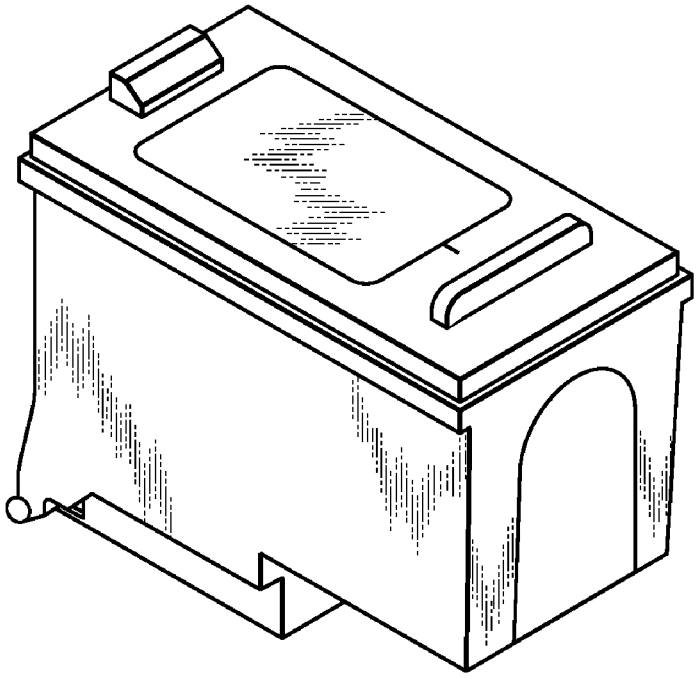
Figure 3:
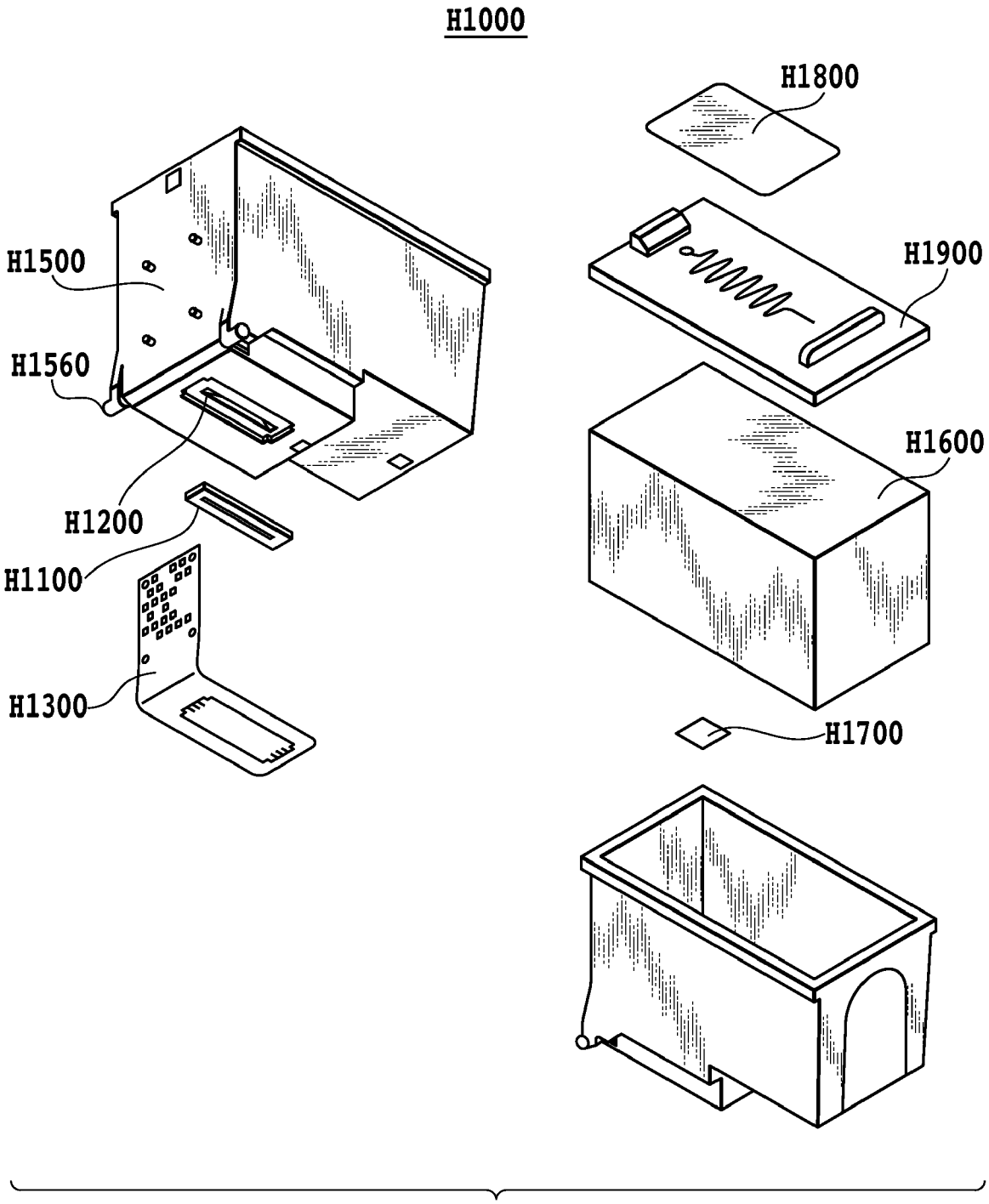
FIG. 3 is an exploded perspective view showing the first printing head of this embodiment.

FIG. 2 is a perspective view showing the first printing head H1000, and FIG. 3 is an exploded perspective view showing the first printing head H1000. Note that, in FIG. 2 and FIG. 3, the configuration of a cavity portion H1540 to be described later (see FIG. 5, FIG. 6, and the like) is not illustrated.

The first printing head comprises a printing element substrate H1100, an electric wiring tape H1300, an ink container H1500, a filter H1700, an ink absorber H1600, a lid member H1900, and a seal member H1800. The ink container H1500 for accommodating ink has the function of an ink tank by having the ink absorber H1600 for holding ink therein and generating a negative pressure. The ink container H1500 is formed by resin-molding, for example. Moreover, the ink container H1500 has an ink supply function by forming an ink flow passage for guiding the relevant ink to the printing element substrate H1100. To a boundary with the ink absorber H1600, the boundary being an upstream portion of the ink flow passage, the filter H1700 for preventing the entry of dust is joined by welding.

In a downstream portion of the ink flow passage, the ink supply port H1200 for supplying a black ink to the printing element substrate H1100 is formed. Moreover, the printing element substrate H1100 is accurately positioned and adhesively secured to the ink container H1500 so that the ink supply port H1102 of the printing element substrate H1100 may communicate with the ink supply port H1200 of the ink container H1500. Moreover, the rear surface of a part of the electric wiring tape H1300 is adhesively secured to a plane adjacent to the bonding surface of the printing element substrate H1100. Then, an un-adhered portion of the electric wiring tape H1300 is folded and secured to the side substantially perpendicular to the bonding surface of the printing element substrate H1100 of the ink container H1500. The lid member H1900 is vibration-welded to an upper opening of the ink container H1500.

Figure 4:
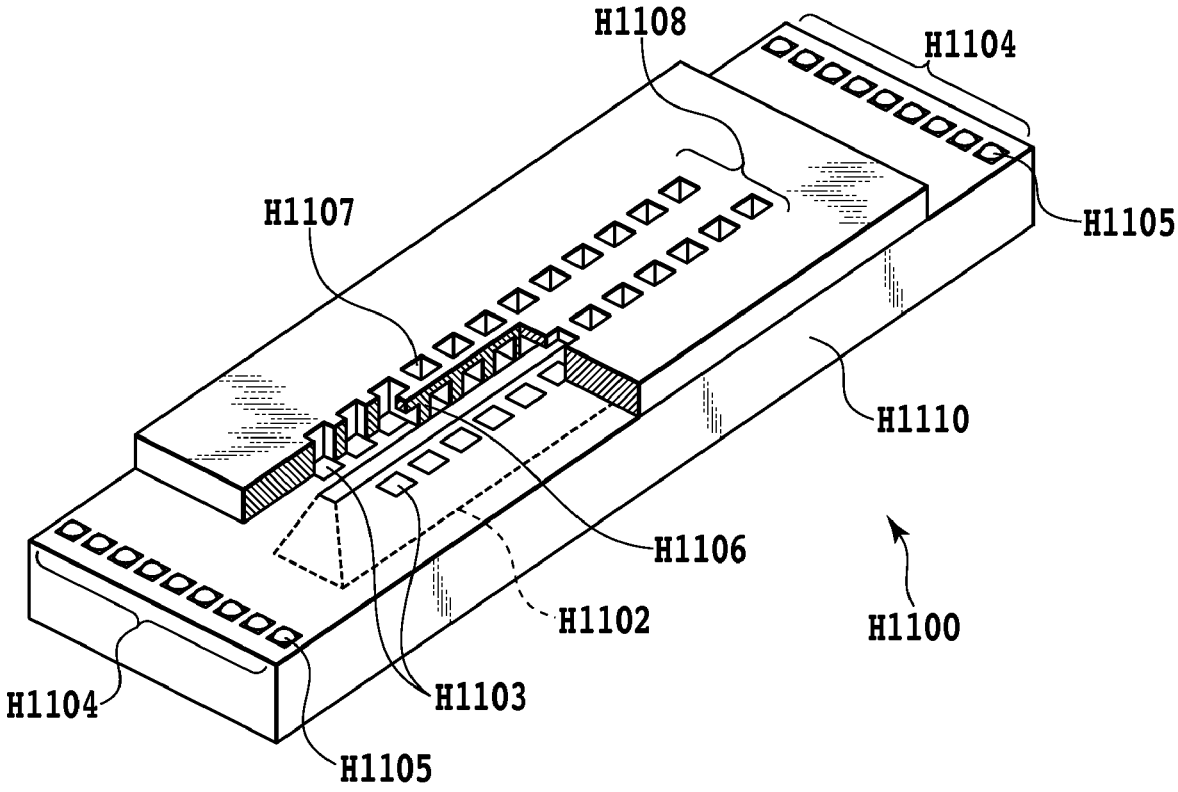
FIG. 4 is a cutaway perspective view showing a printing element substrate of this embodiment.

FIG. 4 is a cutaway perspective view showing the printing element substrate H1100. In a Si substrate H1110, there is formed the ink supply port H1102 that is a through-hole serving as the ink flow passage. In the substrate of this embodiment, the ink supply port H1102 is formed by wet-type anisotropic etching and has a pyramid shape. On both sides across the ink supply port H1102, electrothermal conversion elements H1103 are arranged in a row, respectively. The ink supplied from the ink supply port H1102 is ejected from an ejection port H1107 facing each of the electrothermal conversion elements H1103 by the pressure of bubbles generated by heat generation of each of the electrothermal conversion elements H1103.

Next, a structure for absorbing an impact caused by falling the first printing head H1000 of this embodiment is described.

Figure 5:
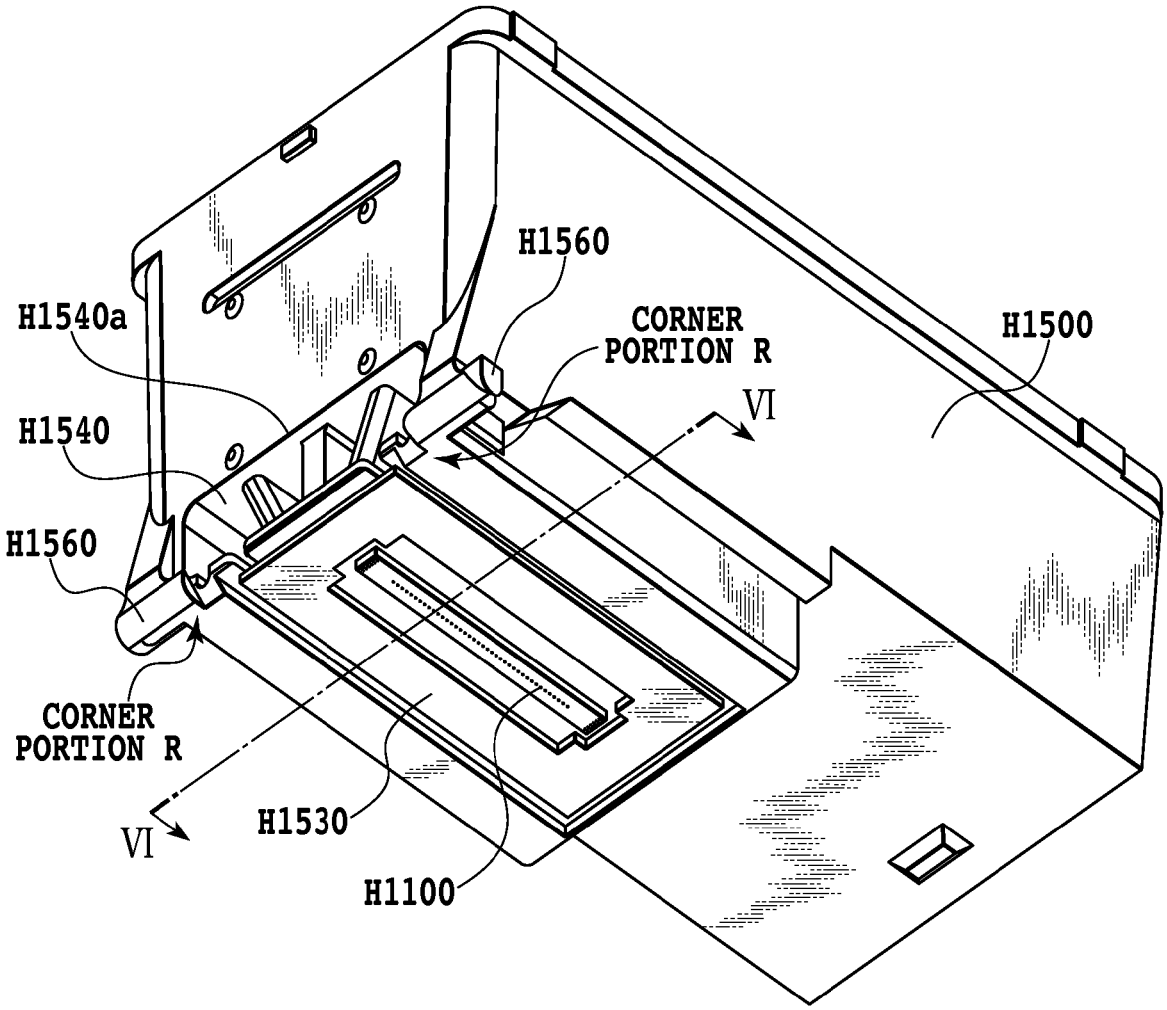
FIG. 5 is an aspect view showing the first printing head of this embodiment.

FIG. 5 is an outline view showing only the ink container H1500 and printing element substrate H1100 among the components constituting the first printing head H1000. A mounting guide H1560 plays a role as a guide for guiding the first printing head H1000 to the mounting position of the carriage 102 of the main body of the inkjet printing apparatus. The cavity portion H1540 is provided for improving the molding stability of the ink container H1500 formed by resin-molding.

Figure 6:
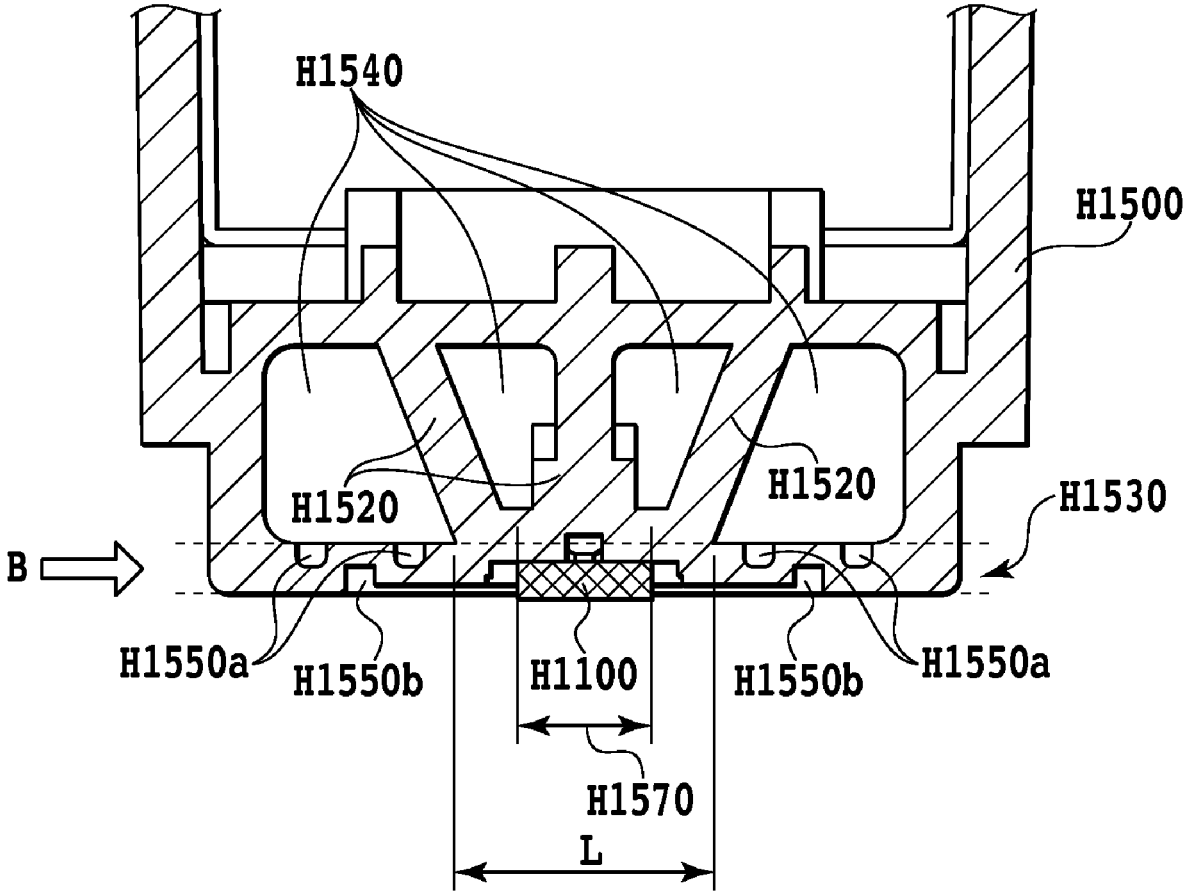
FIG. 6 is a cross-sectional view showing a cross section along a VI-VI line in FIG. 5.

FIG. 6 is a cross-sectional view showing a cross section along a VI-VI line in FIG. 5. The printing element substrate H1100 is adhered to a bonding region H1570 with adhesive. A sheet-shaped portion H1530 is a part of the wall of the cavity portion H1540, and has the bonding region H1570, in which the printing element substrate is secured and arranged, in its major surface. As shown in FIG. 6, the cavity portion H1540 is formed on the rear surface side of the major surface of the sheet-shaped portion H1530 in which the printing element substrate is arranged. On the rear surface side of the sheet-shaped portion H1530, a groove H1550*a* is formed as the concave portion while on the major surface side a groove H1550*b* is formed. The groove H1550*a* will be described in detail later. The groove H1550*b* is 1 mm in width and 0.8 mm in depth. The groove H1550*b* is provided along the edge of the region, to which the electric wiring tape is adhesively bonded, of the major surface of the sheet-shaped portion H1530, at the position along the longitudinal direction of the printing element substrate H1100 (see FIG. 5).

Figure 7:
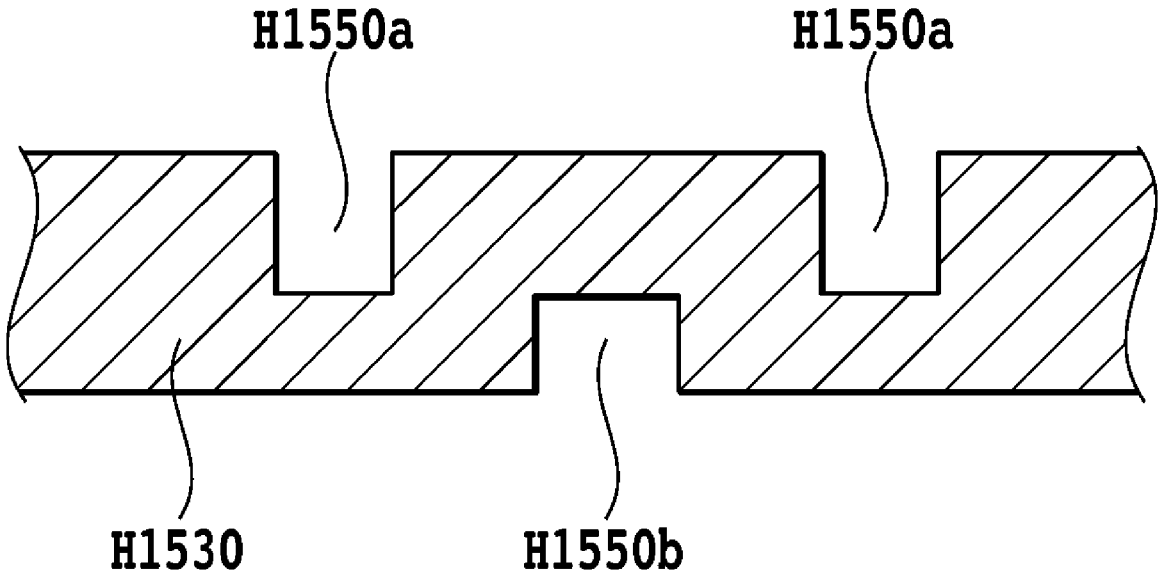
FIG. 7 is a view showing a cross-sectional profile of a configuration of a groove of this embodiment.

FIG. 7 is a view showing a shape different from that shown in FIG. 6, with regard to the cross-sectional profile of the structure of the groove H1550*a*. In this embodiment, as shown in FIG. 7, the grooves may be formed in the form of a crank on both the rear surface side and major surface side of the sheet-shaped portion H1530.

Figure 8:
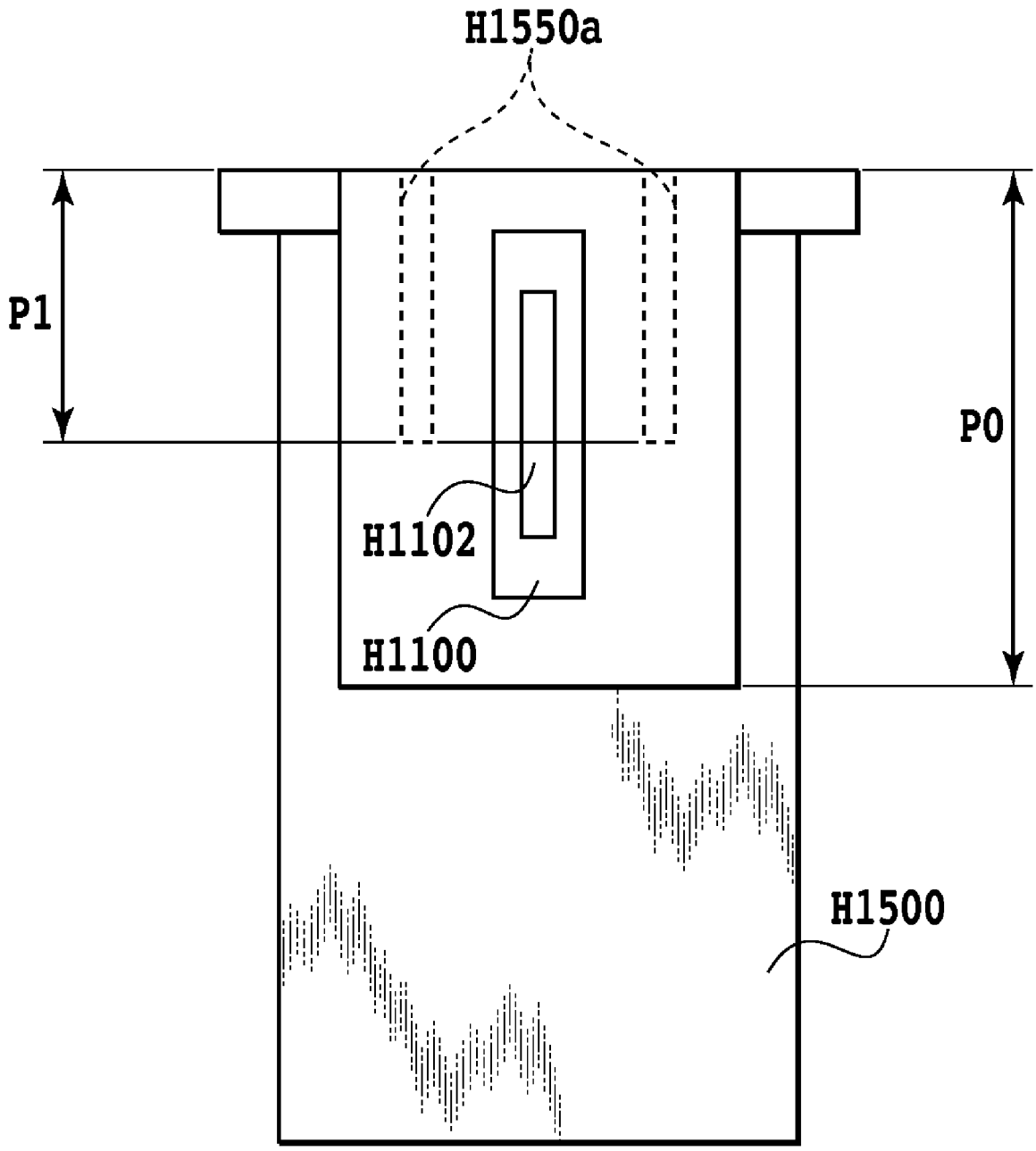
FIG. 8 is a schematic view for showing a range in which the groove of this embodiment is provided.

FIG. 8 is a schematic view for showing a range in which the groove H1550*a* is provided. The groove H1550*a* is provided in a range P1 of the sheet-shaped portion. The range P1 is a range approximately a half of a range P0 of the entire sheet-shaped portion along the longitudinal direction of the printing element substrate H1100, in which the groove H1550*a* is formed along the longitudinal direction of the major surface of the sheet-shaped portion from the opening to a position at least a half the length in the longitudinal direction of the major surface of the sheet-shaped portion.

Next, the characteristic structure of the present invention is described in detail. As shown in FIG. 5, the major surface, in which the printing element substrate H1100 is secured and arranged, of the sheet-shaped portion H1530 is rectangular and has four corner portions that can be regarded substantially as a corner, respectively. The groove H1550*a* is formed on the rear surface side of a region between two corner portions R on the side proximate to the opening H1540*a* among these four corner portions, and the printing element substrates H1100. Note that, in this specification, the "rectangular" shape includes substantially rectangular ones, and for example, includes the one having a protruding portion such as the mounting guide H1560 formed at the corner portion R, as shown in FIG. 5.

Generally, a corner of an object receives an impact first upon fall of the object. Moreover, if an object has a protruding portion, this object is likely to receive a larger impact. Considering the printing head of this embodiment, if the printing head is fallen with the printing element substrate H1100 side facing downward, an impact is most likely to be applied to the mounting guide H1560 first. The direction of an impact applied to the mounting guide H1560 is shown as an arrow B in FIG. 6. In FIG. 6, when an impact is applied in the direction indicated by the arrow B, a region, in which the groove H1530*a* is formed, of the sheet-shaped portions H1530, i.e., a region between the corner portion R and the printing element substrate H1100 becomes likely to deform because the groove H1550*a* is formed in this region. Accordingly, the deformation is unlikely to transmit to the bonding region H1570, in which the printing element substrate H1100 is secured and arranged, of the sheet-shaped portion H1530. As a result, the deformation amount of the bonding region H1570 is reduced and the amount of deformation pertaining to the printing element substrate H1100 can be suppressed. Note that, even in cases where a protruding portion such as the mounting guide H1560 is not formed, a corner portion of the printing head is likely to receive an impact. If the structure of the present invention is used even in such a case, the deformation amount in the bonding region in which the printing element substrate is secured and arranged can be reduced and the amount of deformation pertaining to the printing element substrate can be suppressed.

Moreover, not only by providing the concave portion in the region between the corner portion R and the printing element substrate H1100, but also by expanding the range, in which the concave portion is formed, to the range P1 as described in FIG. 8, the deformation of the printing element substrate against an impact can be further suppressed.

Moreover, in this embodiment, a reinforcing rib H1520 is provided in the cavity portion H1540 so that the deformation of the bonding region H1570 is reduced as much as possible. In a range L shown in FIG. 6, the deformation of the tank container H1500 at the time of falling of the printing head is suppressed by the reinforcing rib H1520.

The groove H1550*a* of this embodiment is 1 mm in width, 0.8 mm in depth, and the length P is set to 115 mm. However, the present invention is not limited to such a dimension.

Moreover, in this embodiment, on both the major surface side and the rear surface side of the sheet-shaped portion, three grooves are provided on one side of the printing element substrate and a total of six grooves are provided on both sides. In addition to the groove H1550*a* formed as the concave portion on the rear surface side of the sheet-shaped portion, by forming the grooves H1550*b* also on the major surface side in this manner, the region between the corner portion R and the printing element substrate becomes more likely to deform. However, in the present invention, the number of grooves is not limited thereto. Namely, the greater the number of grooves, the further an impact due to fall can be absorbed. However, the number of grooves may be no greater than five. Note that, the groove may be formed only on the rear surface side of the major surface of the sheet-shaped portion, or may be formed on both the major surface side and the rear surface side. Moreover, the sheet-shaped portion has on the major surface side thereof an attachment region to which the electric wiring tape H1300 is attached. For this reason, if there is a concave portion such as a groove in the attachment region, it becomes difficult to join the electric wiring tape H1300 to the attachment region. It is therefore difficult to provide a number of grooves on the major surface side of the sheet-shaped portion. Moreover, when the electric wiring tape H1300 is attached by adhesive, the adhesive might enter the groove H1550*b* to reduce an effect of forming the groove H1550*b*. Accordingly, it is preferable to provide more grooves on the rear surface side of the major surface of the sheet-shaped portion. Moreover, as shown in FIG. 6 or FIG. 7, by alternatively placing the concave portion H1550*a* formed on the rear surface side of the major surface of the sheet-shaped portion and the groove H1550*b* formed on the major surface side, the region between the corner portion R and the printing element substrate becomes likely to bend and therefore the amount of deformation pertaining to the printing element substrate can be reduced further.

Although the reinforcing rib H1520 is provided in this embodiment, a structure without the reinforcing rib H1520 may be used.

Although the cross-sectional profile of the portion, in which the groove H1550*a* and the groove H1550*b* are formed, of the sheet-shaped portion of this embodiment described in FIG. 7 is in the form of a crank, the present invention is not limited to such a shape. That is, a shape that can, when a corner portion on the side proximate to the opening of the sheet-shaped portion received an impact, absorb the impact and suppress the amount of deformation pertaining to the printing element substrate may be used.

Figure 9:
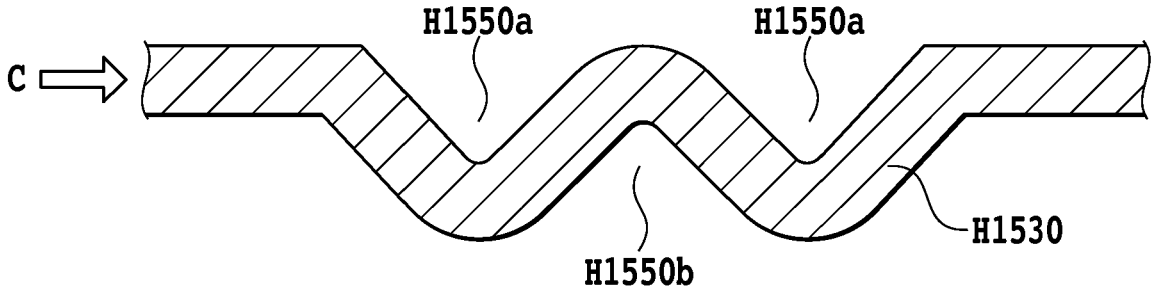
FIG. 9 is a view showing a cross-sectional profile of another configuration of the groove of this embodiment.

FIG. 9 is a view showing another cross-sectional profile of the portion, in which the groove H1550*a* and the groove H1550*b* are formed, of the sheet-shaped portion of this embodiment. As shown in FIG. 9, the sheet-shaped portion has a corrugated tabular cross-sectional profile. Also in the case of this structure, when an impact is applied in the direction indicated by an arrow C in FIG. 9, a region between the corner portion R and the printing element substrate of the sheet-shaped portion becomes likely to deform because the grooves H1550*a* are formed and furthermore the grooves H1550*b* are formed. As a result, upon receipt of an impact, the amount of deformation pertaining to the printing element substrate can be reduced.

As described above, in the first embodiment, a structure in which the groove is formed as the concave portion has been described, however, other than the groove, a hole not extending through the sheet-shaped portion may be formed as the concave portion.

Second Embodiment

In the printing head of the first embodiment, the groove H1550*a* is formed as the concave portion in the rear surface of the region between the printing element substrate and the corner portion R of the major surface of the sheet-shaped portion, of the sheet-shaped portion. However, the present invention is not limited to the concave portion. A structure for absorbing an impact may be formed in the region between the printing element substrate and the corner portion R of the major surface of the sheet-shaped portion, of the sheet-shaped portion holding the printing element substrate.

Figure 10:
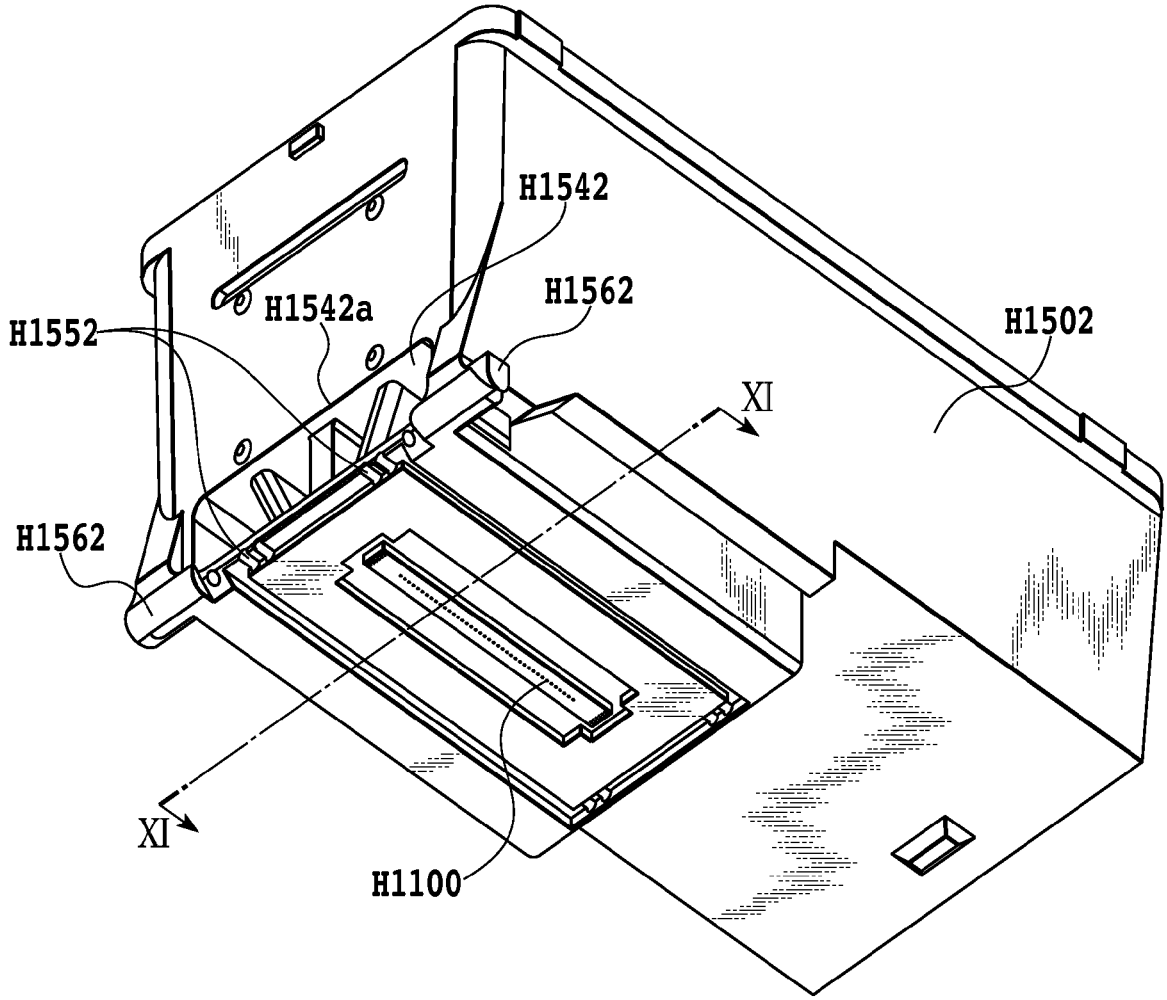
FIG. 10 is a view showing a structure of the first printing head of a second embodiment.
Figure 11:
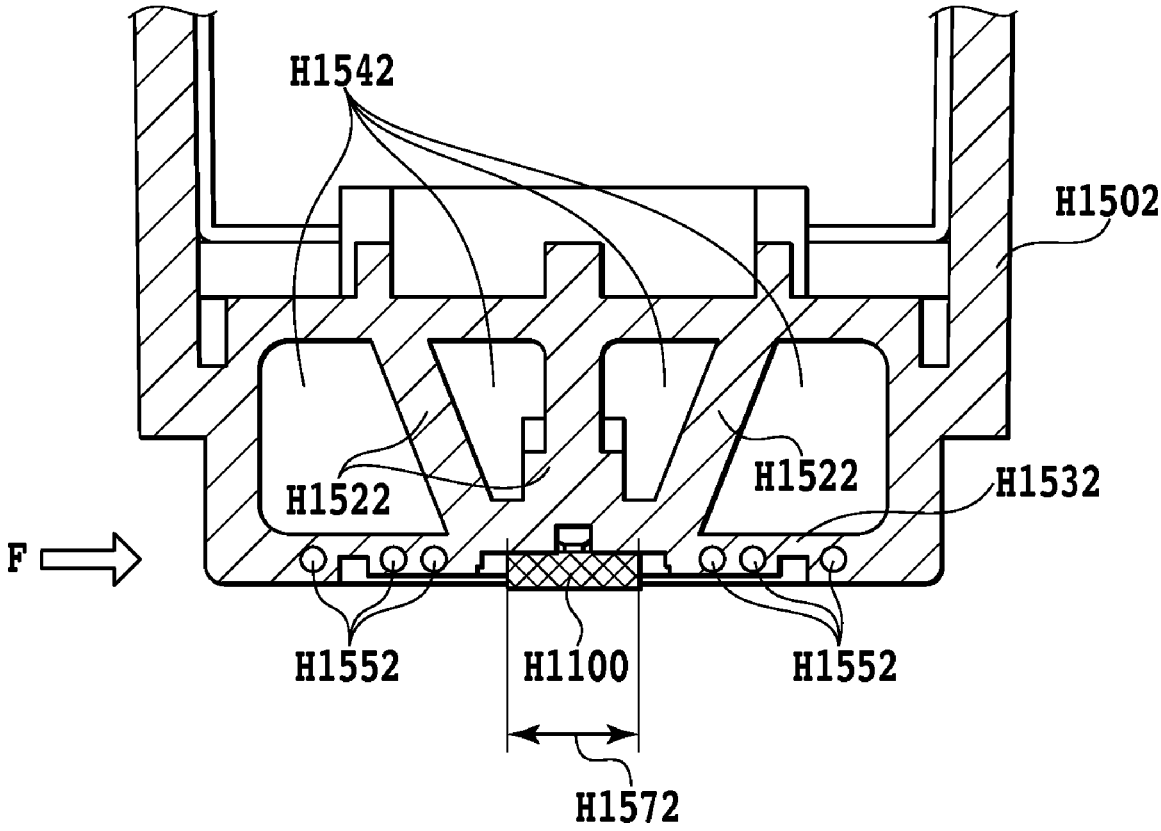
FIG. 11 is a cross-sectional view showing a cross section along a XI-XI line in FIG. 10.

FIG. 10 and FIG. 11 are views showing a structure of the first printing head of this embodiment.

FIG. 10 is an outline view showing only an ink container H1502 and the printing element substrate H1100 among the components constituting the first printing head H1000. A mounting guide H1562 plays a role as a guide for guiding the first printing head H1000 to the mounting position of the carriage 102 of the main body of the inkjet printing apparatus.

FIG. 11 is a cross-sectional view showing a cross section along a XI-XI line in FIG. 10. The printing element substrate H1100 is bonded to a bonding region H1572 by adhesive. A cavity portion H1542 is provided for improving the molding stability of the ink container H1500 formed by resin-molding. Then, a horizontal hole H1552 is formed in a sheet-shaped portion having the bonding region H1572 of the printing element substrate in the major surface. The horizontal hole H1552 is formed along the major surface of the sheet-shaped portion, and is provided inside a sheet-shaped portion H1532 to which an electric wiring tape is adhesively bonded, at a position along the longitudinal direction of the printing element substrate H1100.

The direction of an impact applied to the mounting guide H1562 is shown as an arrow F in FIG. 11. When an impact is applied in the direction indicated by the arrow F in FIG. 11, a portion having the horizontal hole H1552 formed therein of the sheet-shaped portions H1532 becomes likely to deform due to the horizontal hole H1552. Accordingly, the deformation amount of the bonding region H1572 of the printing element substrate H1100 is reduced, and the amount of deformation pertaining to the printing element substrate H1100 can be suppressed.

Modification Embodiment of the Second Embodiment

Figure 12:
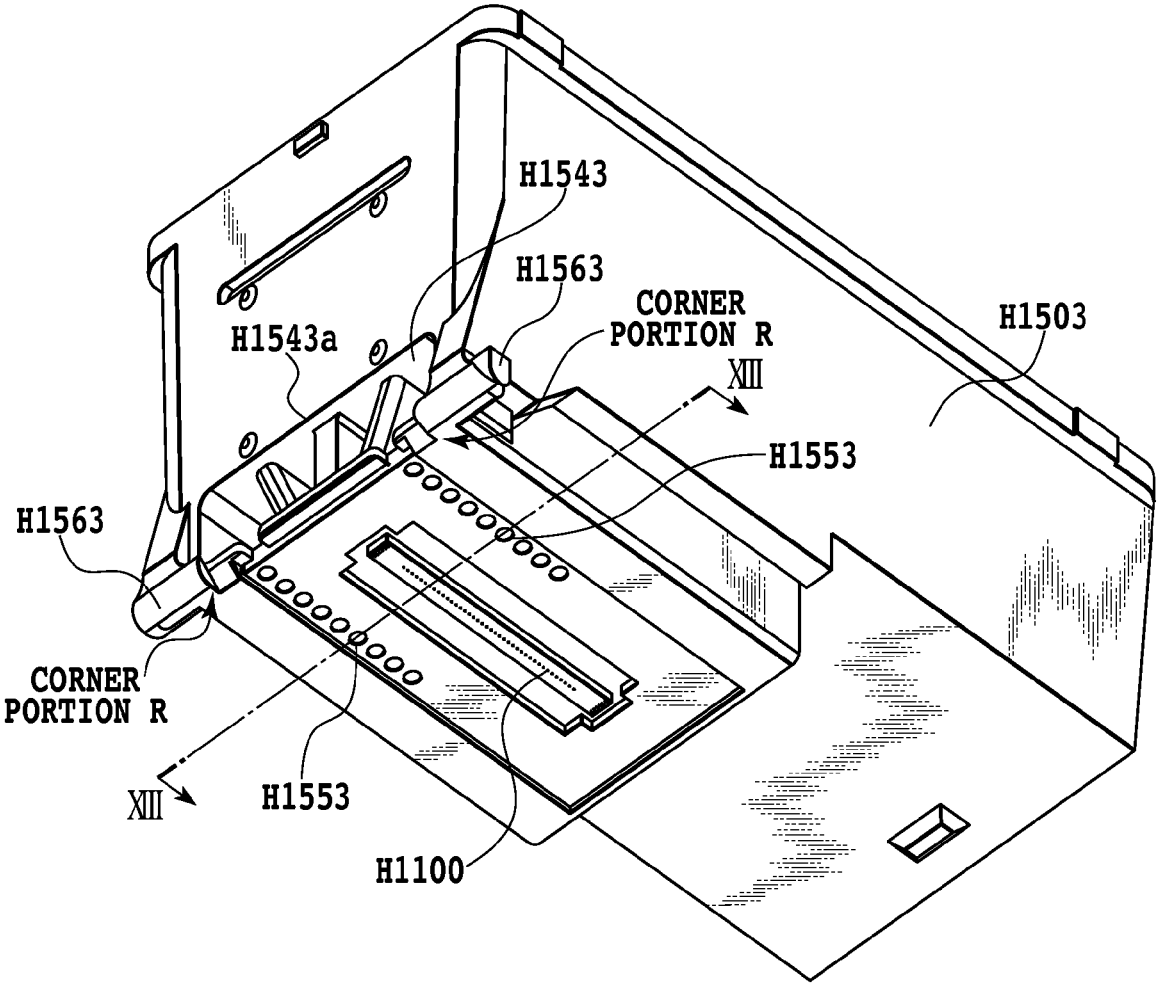
FIG. 12 is a view showing a structure of the first printing head of an alternative embodiment of the second embodiment.
Figure 13:
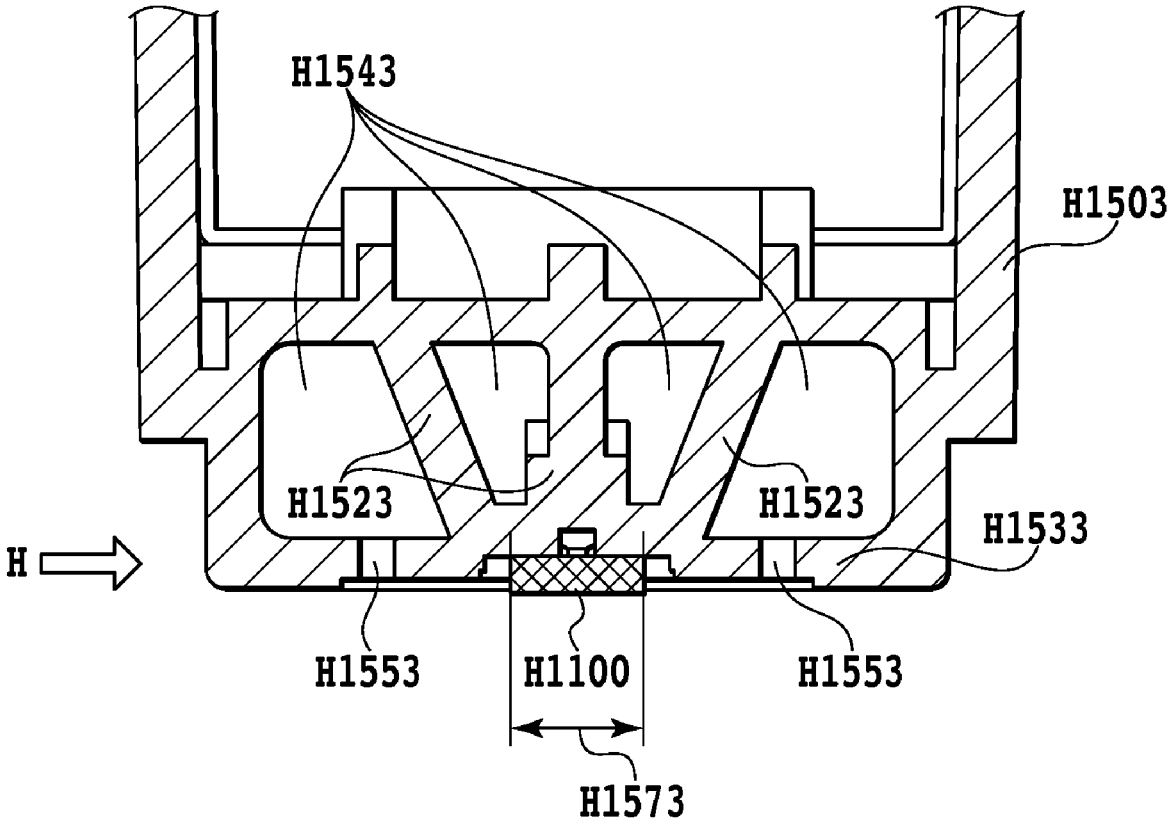
FIG. 13 is a cross-sectional view showing a cross section along a XIII-XIII line in FIG. 12.

FIG. 12 and FIG. 13 are views showing a structure of the first printing head of an alternative embodiment of the second embodiment.

FIG. 12 is an outline view showing only an ink container H1503 and the printing element substrate H1100 among the components constituting the first printing head H1000. A mounting guide H1563 plays a role as a guide for guiding the first printing head H1000 to the mounting position of the carriage 102 of the main body of the inkjet printing apparatus.

FIG. 13 is a cross-sectional view showing a cross section along a XIII-XIII line in FIG. 12. The printing element substrate H1100 is bonded to a bonding region H1573 by adhesive. A cavity portion H1543 is provided for improving the molding stability of the ink container H1500 formed by resin-molding. Then, in a sheet-shaped portion holding the printing element substrate, there is formed a vertical hole H1553 that is a through-hole extending through the major surface and the rear surface of a sheet-shaped portion H1533. A plurality of vertical holes H1553 is formed in the sheet-shaped portion, in rows along the longitudinal direction of the printing element substrate H1100.

The direction of an impact applied to a mounting guide H1563 is shown as an arrow H in FIG. 13. When an impact is applied in the direction indicated by the arrow H in FIG. 13, a sheet-shaped portion H1533 becomes likely to deform due to the vertical hole H1553. Accordingly, the deformation amount of the bonding region H1573 of the printing element substrate H1100 is reduced, and the amount of deformation pertaining to the printing element substrate H1100 can be suppressed.

Although the vertical hole of the alternative embodiment of the second embodiment is a through-hole, the vertical hole may not be a through-hole but may be a vertical hole in the form of a counter-boring head.

Third Embodiment

In the embodiments described above, the structure for absorbing an impact to the sheet-shaped portion holding the printing element substrate is formed from a groove or a hole, however, the present invention is not limited to the structure having a groove or a hole provided in the sheet-shaped portion. A notch may be formed in the sheet-shaped portion.

Figure 14:
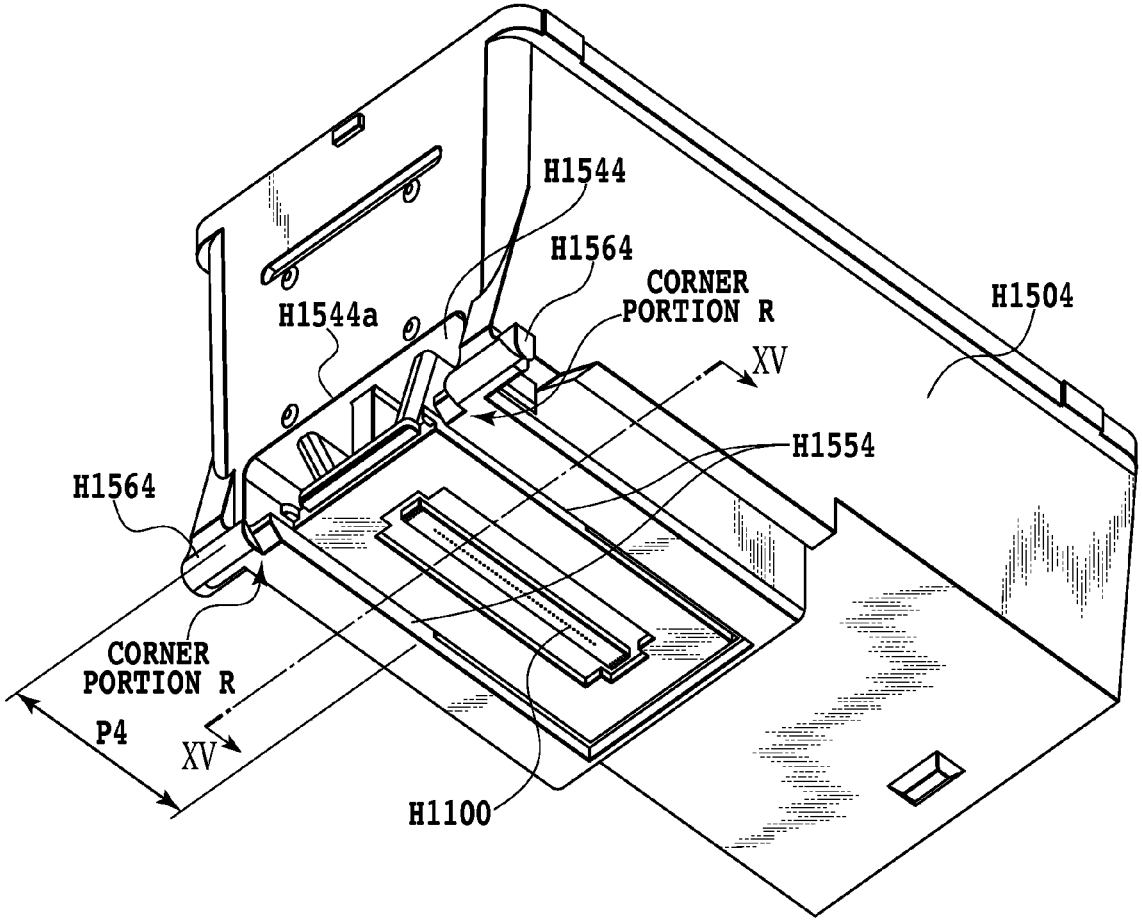
FIG. 14 is a view showing a structure of the first printing head of a third embodiment.

FIG. 14 is an outline view showing only an ink container H1504 and the printing element substrate H1100 among the components constituting the first printing head H1000.

Figure 15:
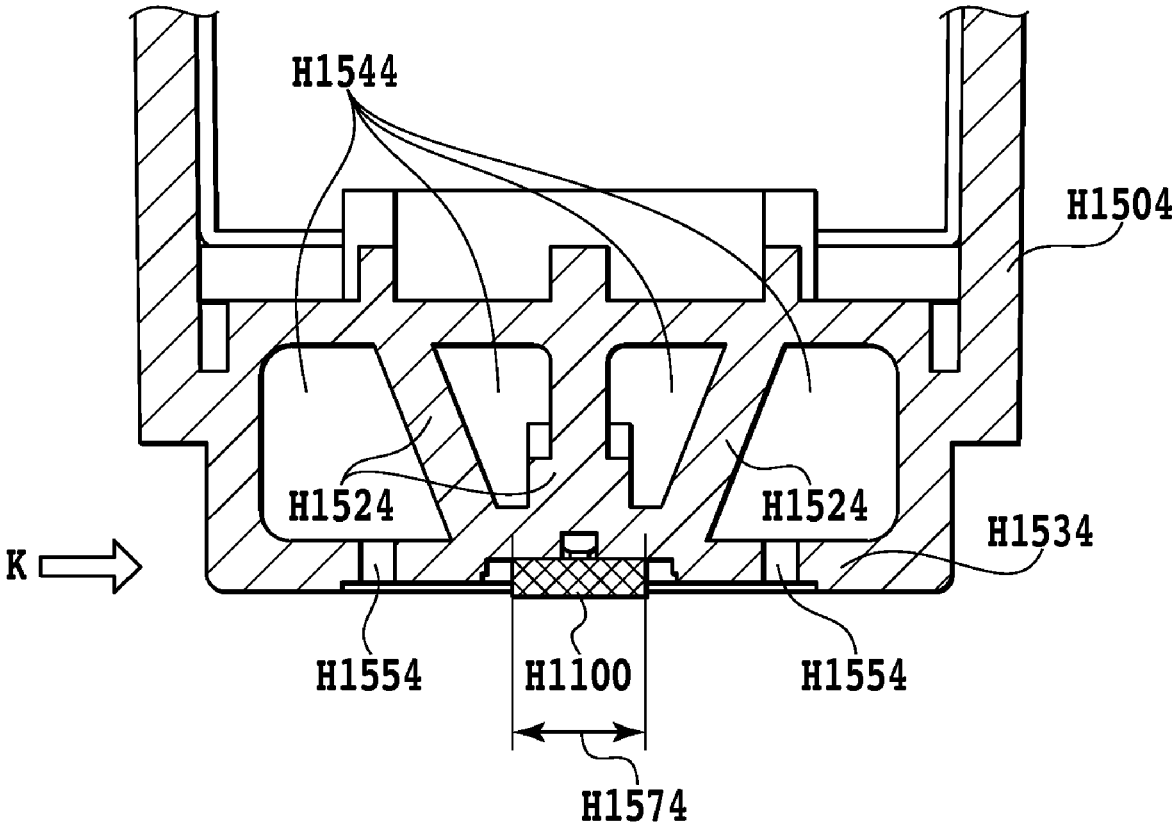
FIG. 15 is a cross-sectional view showing a cross section along a XV-XV line in FIG. 14.

FIG. 15 is a cross-sectional view showing a cross section along a XV-XV line in FIG. 14. The printing element substrate H1100 is bonded to a bonding region H1574 by adhesive. A cavity portion H1544 is provided for improving the molding stability of the ink container H1500 formed by resin-molding. Then, a notch H1554 is formed in a sheet-shaped portion holding the printing element substrate. The notch H1554 is provided at two places corresponding to regions between the corner portion R and the printing element substrate H1100 so as to cut in the sheet-shaped portion from an opening H1544*a* side, along the longitudinal direction of the printing element substrate H1100. Moreover, the notch H1554 is preferably formed from the opening H1544*a* to a position at least a half the longitudinal length of the major surface of the sheet-shaped portion, along the longitudinal direction of the major surface of the sheet-shaped portion. In other words, the notch H1554 is preferably provided in at least a half the region on the mounting guide side of the sheet-shaped portion (a range P4 of FIG. 14). By forming the notch H1554 extending to such a range, the amount of deformation pertaining to the printing element substrate can be suppressed further.

The direction of an impact applied to a mounting guide H1564 is shown as an arrow K in FIG. 15. When an impact is applied in the direction indicated by the arrow K in FIG. 15, a sheet-shaped portion H1534 becomes likely to deform due to the notch H1554. Accordingly, the deformation amount of the bonding region H1574 of the printing element substrate H1100 is reduced, and the amount of deformation pertaining to the printing element substrate H1100 can be suppressed.

Fourth Embodiment

A printing head of a fourth embodiment has an R-shaped portion provided at corner portions of the cavity portion of the above-mentioned embodiments.

Figure 16:
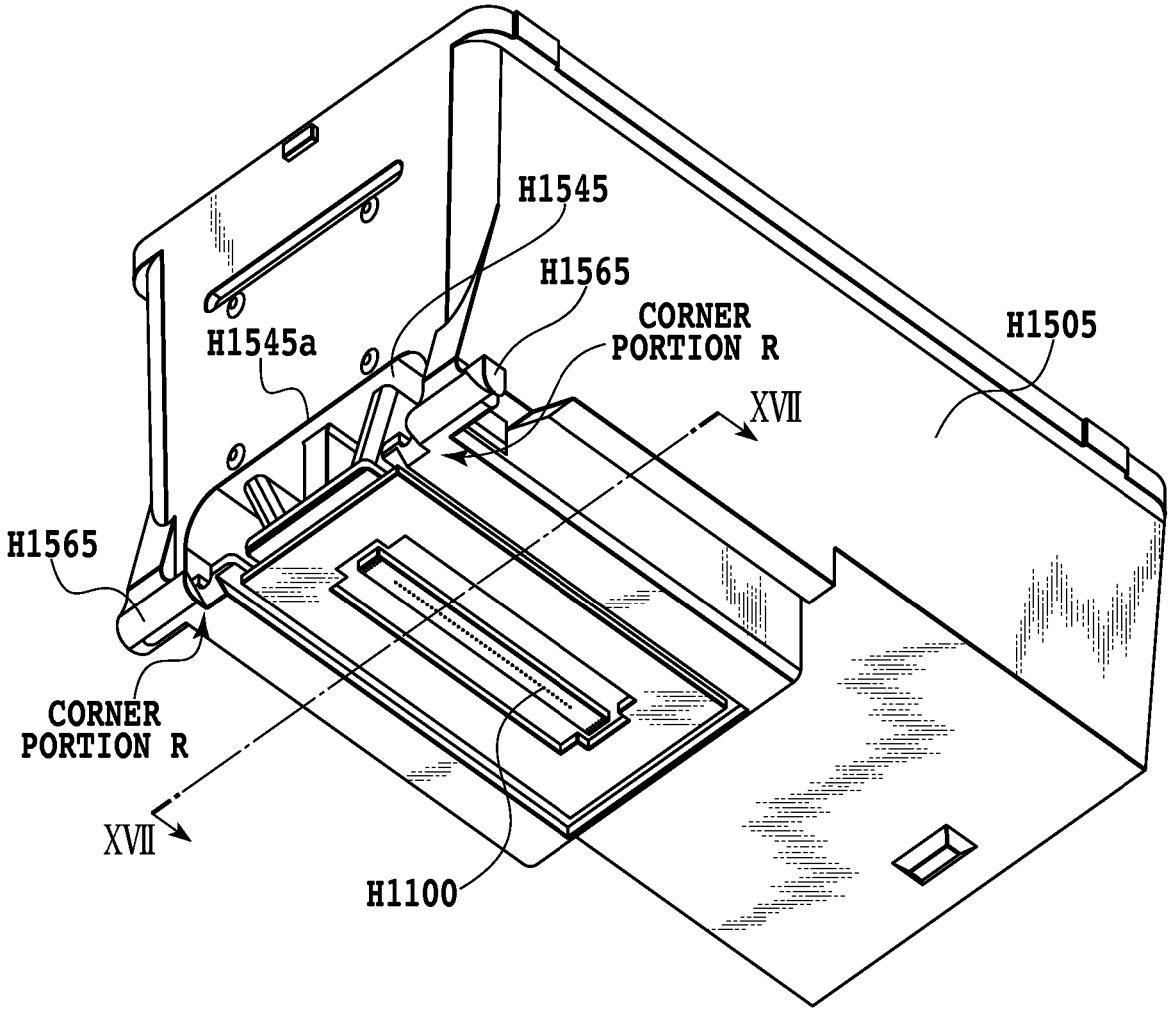
FIG. 16 is a view showing a structure of the first printing head of a fourth embodiment.

FIG. 16 is an outline view showing only an ink container H1505 and the printing element substrate H1100 among the components constituting the first printing head H1000.

Figure 17:
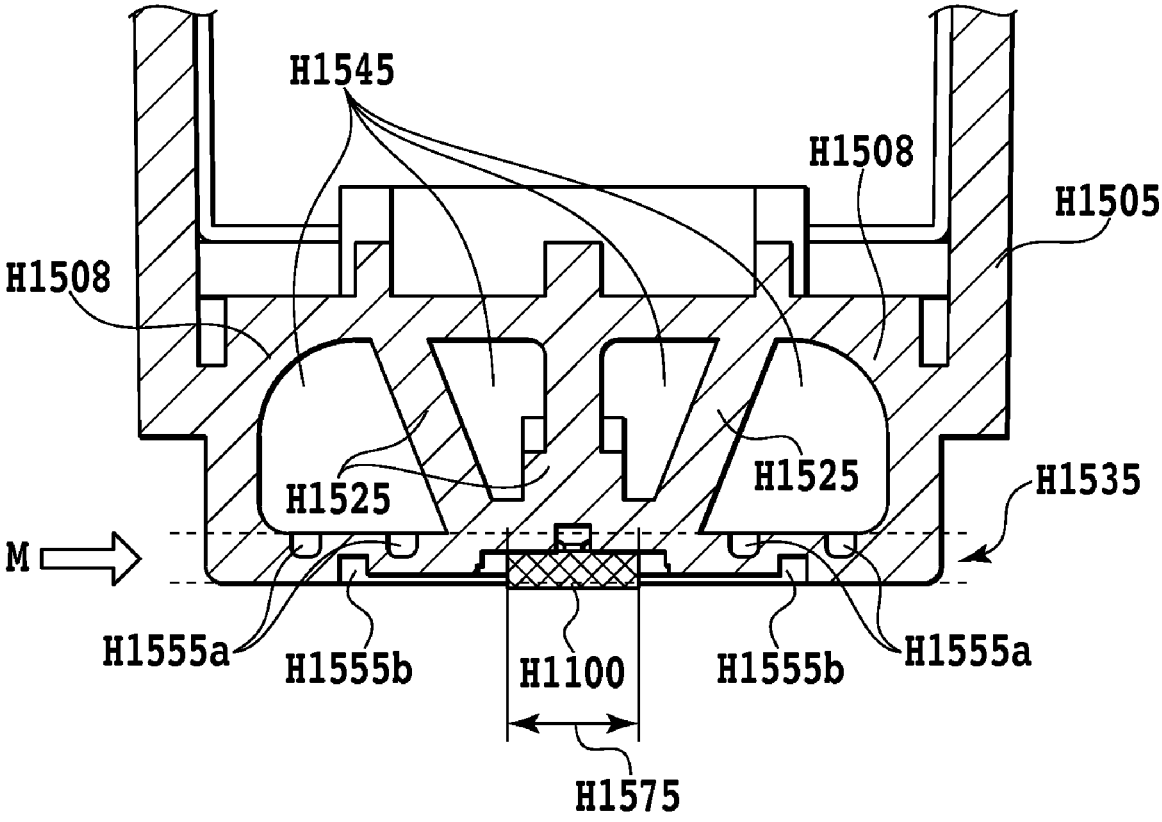
FIG. 17 is a cross-sectional view showing a cross section along a XVII-XVII line in FIG. 16.

FIG. 17 is a cross-sectional view showing a cross section along a XVII-XVII line in FIG. 16. The printing element substrate H1100 is bonded to a bonding region H1575 by adhesive. Grooves H1555*a*, 1555*b* are formed in the sheet-shaped portion holding the printing element substrate, as with the first embodiment. An R-shaped portion H1508 is provided at the corner of the cavity portion H1545.

The direction of an impact applied to a mounting guide H1565 is shown as an arrow M in FIG. 17. In FIG. 17, when an impact is added in the direction indicated by the arrow M, an end portion H1509 of a sheet-shaped portion H1535 becomes unlikely to deform in the direction indicated by the arrow M due to the R-shaped portion H1508. Accordingly, the deformation amount in the interior of the end portion H1509 of the sheet-shaped portion H1535 can be reduced. As a result, the deformation amount of the bonding region H1575 of the printing element substrate H1100 is reduced, and the amount of deformation pertaining to the printing element substrate H1100 can be suppressed further.

Other Embodiments

In the embodiments described above, one or two grooves, holes, notches, or the like formed in the sheet-shaped portion holding the printing element substrate are provided on both sides of the printing element substrate H1100, respectively. However, the present invention shall not be limited to such a position and number as long as the grooves, holes, notches, or the like are provided in a region between the corner portion R and the printing element substrate H1100.

Figure 18:
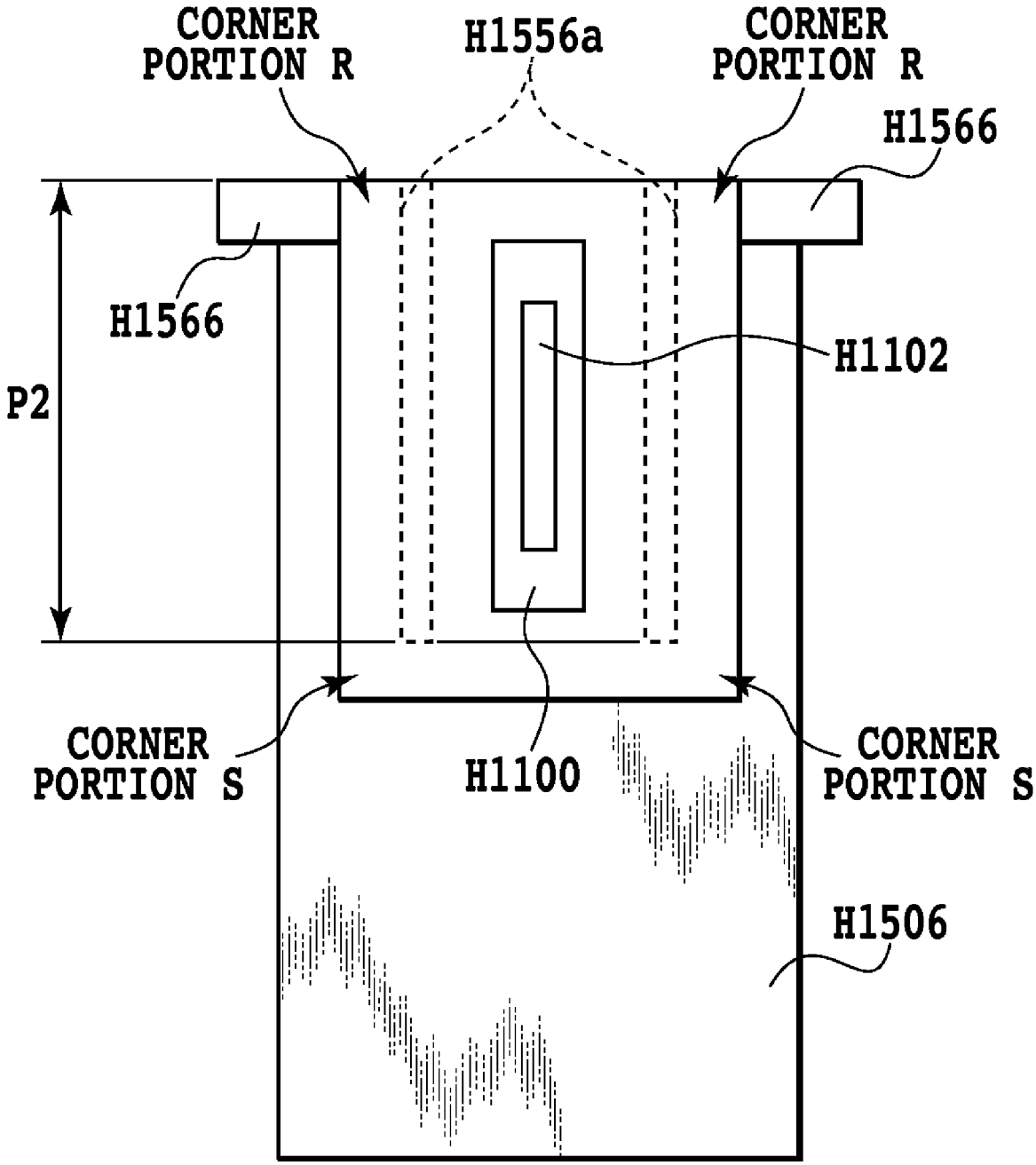
FIG. 18 is an explanatory view showing the position and number of grooves, holes, notches, or the like formed in a sheet-shaped portion.
Figure 19:
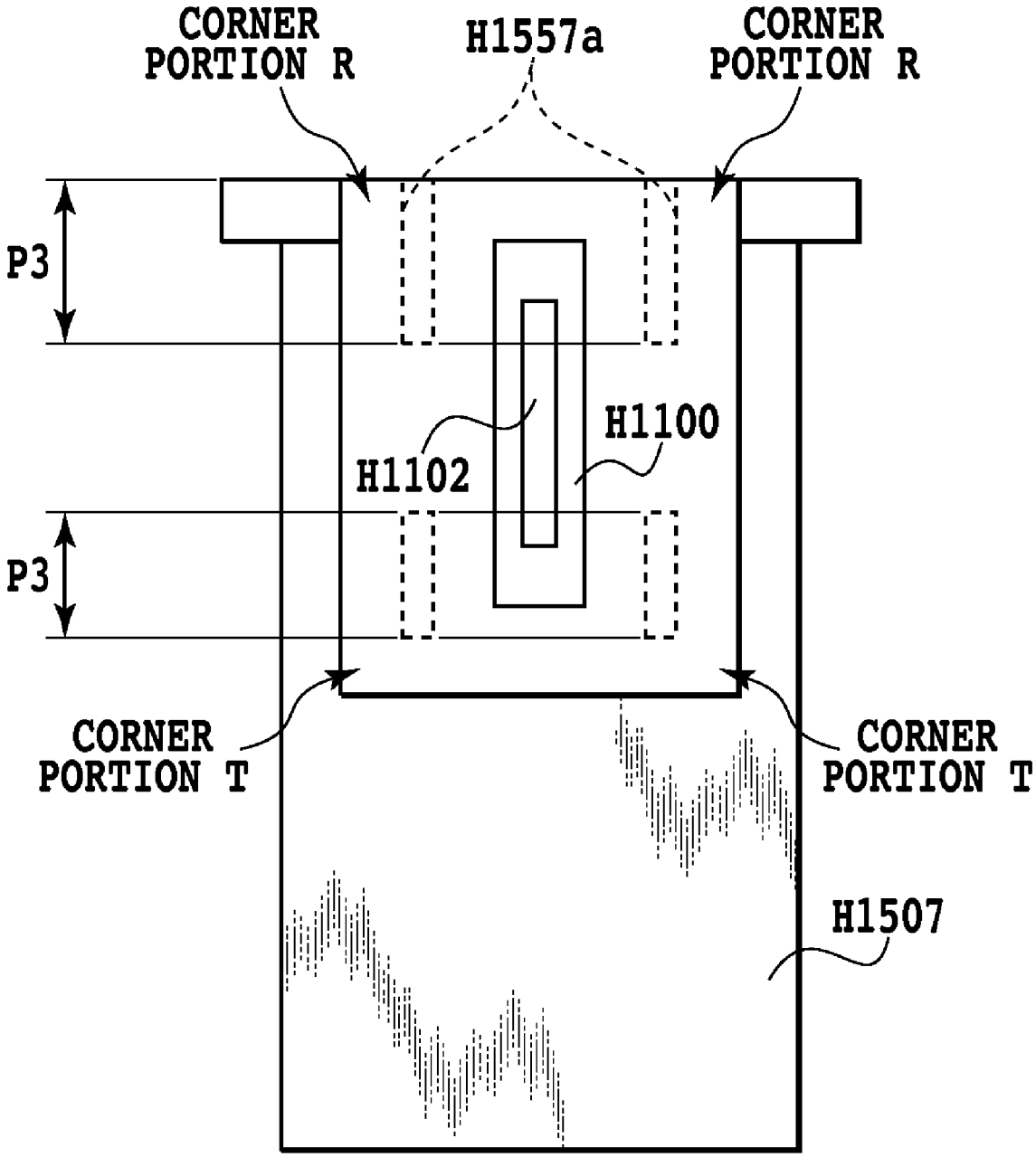
FIG. 19 is an explanatory view showing the position and number of grooves, holes, notches, or the like formed in a sheet-shaped portion.
Figure 20:
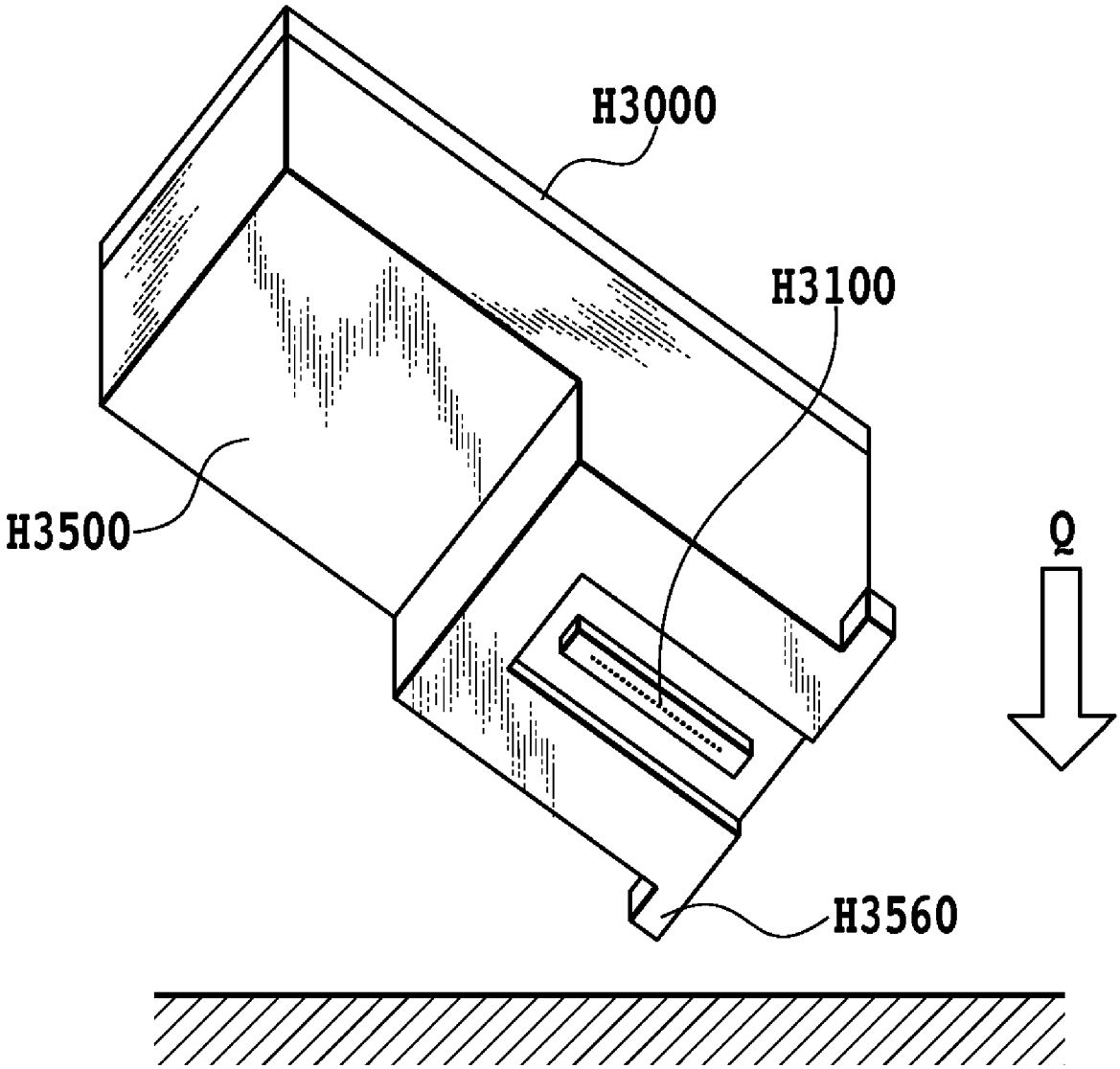
FIG. 20 is a view showing a state immediately before a printing head is fallen onto a floor.
Figure 21:
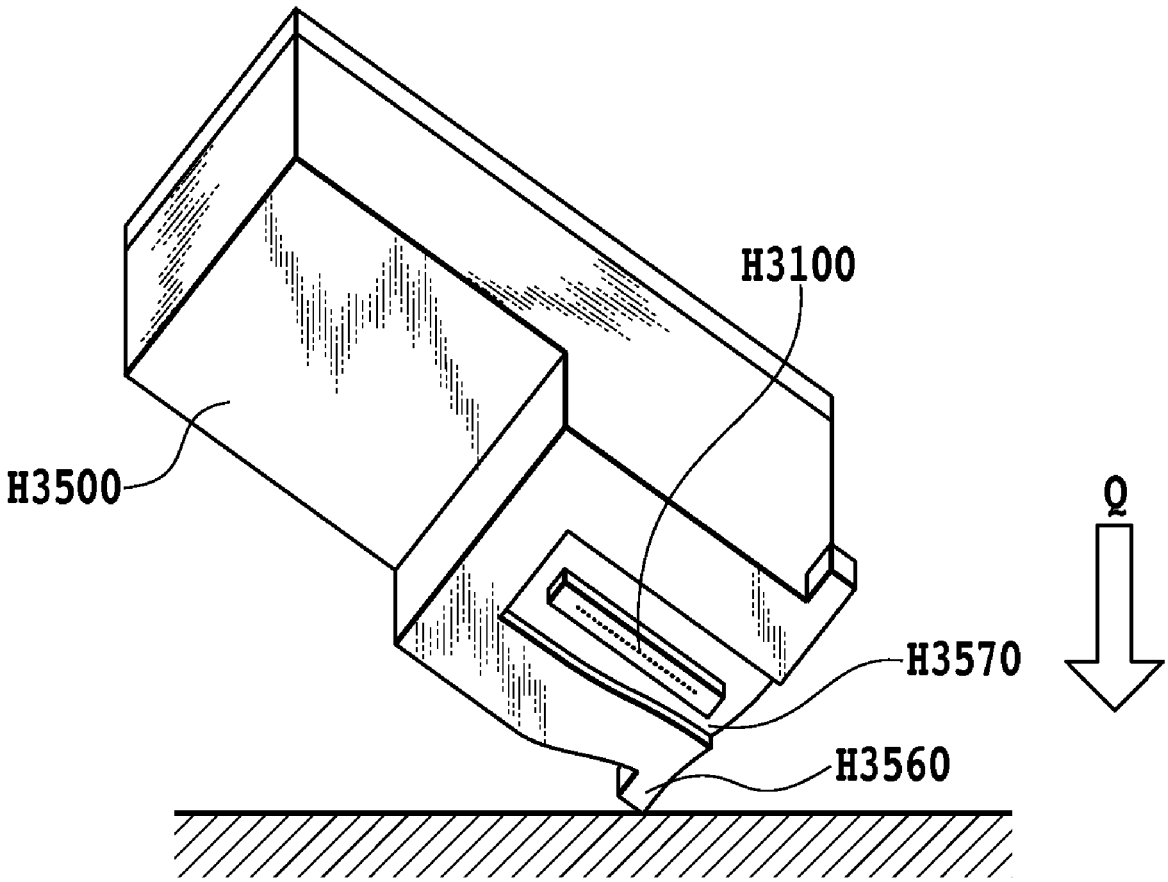
FIG. 21 is a view showing a state immediately after the printing head is fallen onto the floor.

FIG. 18 and FIG. 19 are explanatory views showing the position and number of grooves, holes, notches, or the like formed in the sheet-shaped portion holding the printing element substrate.

In a printing head shown in FIG. 18, a structure H1556*a* such as a groove, hole, notch, or the like, is provided in a substantially entire region (P2 region) along the longitudinal direction of the printing element substrate H1100. By means of such a configuration, even if an impact is applied not only to a mounting guide H1566 provided at a corner portion R but also to a corner portion S at the time of falling the printing head, the amount of deformation pertaining to the printing element substrate H1100 can be suppressed.

Moreover, in a printing head shown in FIG. 19, a structure H1557*a*, such as a groove, a hole, a notch, or the like, is provided at places (P3 region) corresponding to four corners of the rectangular ink supply port H1102 formed in the printing element substrate H1100. By means of such a configuration, even if an impact is applied to a corner portion T at the time of falling of the printing head, the amount of deformation pertaining to the printing element substrate H1100 can be suppressed. It is therefore possible to prevent a crack from a corner portion, on which a stress tends to concentrate, of the ink supply port H1102 from occurring to the printing element substrate. If the ink supply port is rectangular, a stress tends to concentrate on a corner of the ink supply port. Therefore, the shape of the printing element substrate is not limited to a rectangular. However, as shown in FIG. 19, formation of a rectangular ink supply port whose long side and short side are parallel to the rectangular printing element substrate is more preferable because the ink supply port can be efficiently formed with respect to the printing element substrate.

Note that, in the embodiments described above, a printing head integrated with an ink tank has been described, however, the present invention can be applied to a printing head with a separate ink tank, as well. Moreover, in the embodiments described above, a monochromatic printing head has been described, however, the present invention can be applied to a multi-color printing head, as well. Furthermore, the configuration of the printing head of the present invention may be a combination of those of the first embodiment to fourth embodiment, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-157900, filed Jun. 17, 2008, and 2009-120038 filed May 18, 2009 which are hereby incorporated by reference herein in their entirety.

What is claimed is:

1. A printing head, comprising:

a printing element substrate for printing by ejecting ink and including an ejection port; and an ink supply member for supplying ink to said printing element substrate and including a sheet-shaped portion having a front surface including a securing region to which said printing element substrate is secured and a rear surface opposite to the front surface and forming a part of a space, wherein a surface adjacent to the front surface is provided with an opening to the space, and wherein said sheet-shaped portion is provided with a concave portion formed on the rear surface in a region between an end portion of the securing region on a side of the adjacent surface and an end portion of the front surface on a side of the adjacent surface and outside of the securing region in a direction along the end portion of the securing region.

2. The printing head according to claim 1, wherein the concave portion comprises a groove.

3. The printing head according to claim 2, wherein the groove is configured to be formed so as to extend from the opening to a position corresponding to at least a half length of said printing element substrate, relative to an arrangement direction of a plurality of ejection ports, along the arrangement direction.

4. The printing head according to claim 2, wherein the groove extends from the adjacent surface to at least a position overlapped with the securing region in the direction along the end portion of the securing region.

5. The printing head according to claim 1, wherein the rear surface of said sheet-shaped portion is provided with a plurality of concave portions formed thereon.

6. The printing head according to claim 1, wherein said sheet-shaped portion is provided with a concave portion formed on the rear surface in a region between an end portion of the securing region on an opposite side of the adjacent surface and an end portion of the front surface on an opposite side of the adjacent surface and outside of the securing region in the direction along the end portion of the securing region.

7. The printing head according to claim 1, wherein said concave portion is provided on two of the regions of the rear surface.

8. The printing head according to claim 7, wherein two of the concave portions are provided on each of the two regions of the rear surface and the front surface is provided with a concave portion between the two concave portions provided on the rear surface, respectively.

9. A printing head, comprising:

a printing element substrate for printing by ejecting ink and including an ejection port; and an ink supply member for supplying ink to said printing element substrate and including a sheet-shaped portion having a front surface including a securing region to which said printing element substrate is secured and a rear surface opposite to the front surface, the rear surface of said sheet-shaped portion being provided with a space formed separately from an ink flow passage, wherein a surface adjacent to the front surface is provided with an opening to the space, and wherein said sheet-shaped portion is provided with a notch formed in a region between an end portion of the securing region on a side of the adjacent surface and an end portion of the front surface on a side of the adjacent surface and outside of the securing region in a direction along the end portion of the securing region.

10. The printing head according to claim 9, wherein the notch extends from the adjacent surface to at least a position overlapped with the securing region in the direction along the end portion of the securing region.

11. A printing head, comprising:

a printing element substrate for printing by ejecting ink and including an ejection port; and an ink supply member for supplying ink to said printing element substrate and including a sheet-shaped portion having a front surface including a securing region to which said printing element substrate is secured and a rear surface opposite to the front surface, the rear surface of said sheet-shaped portion being provided with a space formed separately from an ink flow passage, wherein a surface adjacent to the front surface is provided with an opening to the space, and wherein said sheet-shaped portion is provided with a hole formed along the front surface in a region between an end portion of the securing region on a side of the adjacent surface and an end portion of the front surface on a side of the adjacent surface and outside of the securing region in a direction along the end portion of the securing region.

12. A printing head, comprising:

a printing element substrate for printing by ejecting ink and including an ejection port; and an ink supply member for supplying ink to said printing element substrate and including a sheet-shaped portion having a front surface including a securing region to which said printing element substrate is secured and a rear surface opposite to the front surface, the rear surface of said sheet-shaped portion being provided with a space formed separately from an ink flow passage, wherein a surface adjacent to the front surface is provided with an opening to the space, and wherein said sheet-shaped portion is provided with a through-hole formed in a region between an end portion of the securing region on a side of the adjacent surface and an end portion of the front surface on a side of the adjacent surface and outside of the securing region in a direction along the end portion of the securing region, the through-hole extending through the front surface and the rear surface of said sheet-shaped portion.

* * * * *